United States Patent [19]

LaMontagne et al.

[11] Patent Number: 4,827,864

[45] Date of Patent: May 9, 1989

[54] REMOVABLE CASTING DECK/STORAGE LOCKER FOR A BASS BOAT

[75] Inventors: Brad LaMontagne, Nashville; Elwood Kotil, White Bluff; Bob Collins, Brentwood, all of Tenn.

[73] Assignee: Outboard Marine Corporation, Waukegan, Ill.

[21] Appl. No.: 87,671

[22] Filed: Aug. 20, 1987

[51] Int. Cl.[4] ..... B63B 17/00

[52] U.S. Cl. ..... 114/343; 114/364

[58] Field of Search ..... 114/343, 364, 363

[56] References Cited

U.S. PATENT DOCUMENTS 3,839,757 10/1974 Grimes ..... 114/363
4,567,845 2/1986 Smith ..... 114/343 X
4,662,303 5/1987 Duff ..... 114/343

*Primary Examiner*—Sherman D. Basinger
*Attorney, Agent, or Firm*—Hubbard, Thurman, Turner & Tucker

[57] ABSTRACT

A removable, combination casting deck and storage locker unit is provided which may be dropped into the walk-through area extending between the control console and elevated front fishing deck portions of a bass boat to provide additional enclosed storage space on the boat and to form a rearward extension of the front elevated deck portion. In this manner, more than one angler can fish from an elevated casting area at the more desirable bow end of the boat. The unit may be easily and quickly removed from the walk-through area, and stored in a suitable location, to return the bass boat to its conventional fishing configuration.

4 Claims, 1 Drawing Sheet

REMOVABLE CASTING DECK/STORAGE LOCKER FOR A BASS BOAT

BACKGROUND OF THE INVENTION

The present invention relates generally to boating devices, and more particularly provides a removable, drop-in combination casting deck and storage locker unit which is positionable in the walk-in through passage area between the control console and the elevated forward deck area in a bass boat to considerably increase the elevated fishing platform area of the bow end of the boat, while at the same time adding useful enclosed storage area to the boat.

In recent years, specialized fishing craft known as "bass boats" have become extremely popular with both professional and amateur fresh water bass fisherman. The typical bass boat is generally provided with a centrally positioned control console disposed between elevated bow and stern fishing and casting deck portions. These two elevated deck portions are each typically provided with pedestal-type fishing chairs to add to the comfort of a day's fishing expedition. Extending forwardly from adjacent the control console to the forward elevated deck portion, and flanked by raised storage compartment structures, is a "walk-through" area which extends along the floor of the boat.

While bass boats of this general configuration have proven to be quite well suited to their rather specialized purpose, they are subject to one primary limitation—namely, the two elevated deck portions each are designed and sized to comfortably accommodate only one fisherman. A normal mode of using a bass boat of this type during fishing is to move the boat forwardly along a shore line area or other suitable fishing structure, by means of a bow-mounted electric motor operated by the forward fisherman, while each fisherman makes a series of casts toward the particular fishing structure.

The somewhat limited total elevated fishing deck area built into the conventional bass boat typically results in the necessity of a third fisherman utilizing the less desirable non-elevated deck portion of the boat. Additionally, it is rather well known that particularly in tournament fishing, the bow angler has somewhat of an advantage over the angler in the stern due to the fact that the bow angler has, in effect, the first "shot" at prime casting targets which he may cover thoroughly before the stern angler has a chance to cast to them. Additionally, the bow angler has a further advantage due to his control of the overall movement and positioning of the boat during fishing. He may thus (either intentionally or inadvertently) position and guide the boat to his advantage and to the stern angler's disadvantage.

It is accordingly an object of the present invention eliminate these disadvantages and limitations commonly associated with conventional bass boats of the general configuration described above.

SUMMARY OF THE INVENTION

In carrying out principles of the present invention, in accordance with a preferred embodiment thereof, a removable casting deck/storage locker structure is provided which may be simply dropped into the forward walk-through area of a bass boat to significantly increase the area of its forward elevated fishing deck area.

The casting deck/storage locker unit is basically a sturdily constructed, generally box-shaped structure which is dimensioned to be closely received in and essentially fill the walk-through area. The unit has a hinged upper lid portion which, in its closed position, is flush with the upper surface of the elevated forward fishing deck and the upper surfaces of the storage compartment structures which are positioned on opposite sides of the walk-through area. Disposed in this manner in the walk-through area, the deck and storage locker unit significantly increases the elevated deck area at the bow of the boat. The additional "walk around" area provided by the drop-in unit affords the fishermen much greater mobility around the front elevated area, enabling both partners to comfortably utilize the front casting deck area. Additionally, of course, in the event that three fisherman are using the boat, two fisherman can comfortably use the extended front elevated deck area, while the third fisherman uses the rear elevated deck portion.

The drop-in deck and locker unit also affords additional lockable storage space underneath the now-extended deck for tackle boxes, life jackets or other equipment. The unit may be quickly removed from its position within the walk-through space when desired (and removed from the boat and stored elsewhere) to return the boat to its conventional two-person fishing layout.

DETAILED DESCRIPTION

Figure 1:
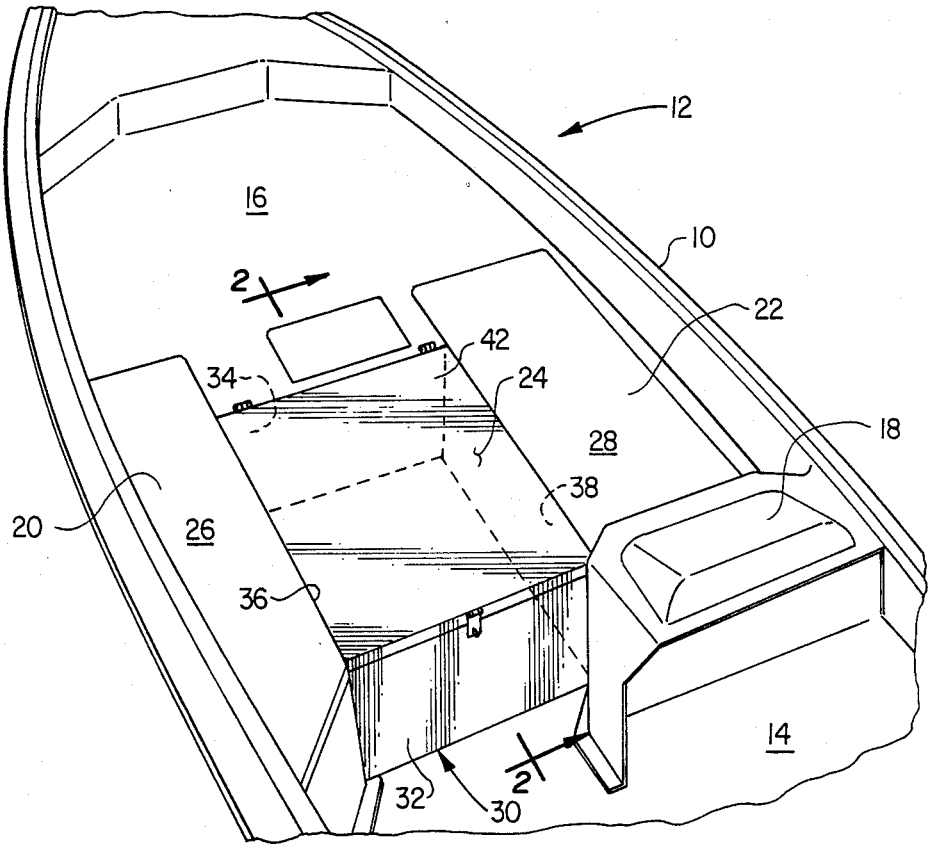
FIG. 1 is a perspective view of a bow portion of a bass boat having operatively positioned in its walk-through area a removable casting deck/storage locker unit of the present invention which provides additional storage area in the boat and forms an extension of its forward elevated fishing deck area.

Perspectively illustrated in FIG. 1 is a bow portion 10 of a bass boat 12 having a floor 14, an elevated fishing deck area 16 positioned at the forward end of the bow portion 10, and a control console 18 positioned rearwardly of the elevated deck 16 on the right side of the boat. Extending laterally inwardly from the opposite sides of the boat between the elevated deck area 16 and the console 18 are a pair of elevated storage locker units 20 and 22 which define therebetween a downwardly offset "walk-through" area 24 which extends along the boat floor 14 from adjacent the console 18 to the elevated deck area 16. The lockers 20, 22 are respectively provided with hinged lid portions 26 and 28 which may be pivoted upwardly to open the lockers for storage of various fishing and other equipment therein. With the lids 26, 28 in their closed position illustrated in FIG. 1, their upper surfaces are flush with the upper surface of the elevated deck area 16 and define relatively narrow rearward extensions thereof.

In the conventional bass boat 12 illustrated in FIG. 1, the total area of the elevated deck area 16 is relatively small and provides a comfortable fishing platform for only one angler. A similar elevated deck area (not shown) is also provided at the stern of the boat. Each of these two elevated deck areas are typically provided with a removable, pedestal fishing chair for use by the single fisherman on each of the two deck areas. Thus, bass boats of the conventional construction depicted in FIG. 1 provide desirable elevated casting areas for only two anglers.

To provide both additional front elevated fishing deck area and more enclosed storage area on the boat, the present invention uniquely provides a removable, drop-in casting deck and storage locker unit 30 which may be easily and quickly inserted into the walk-through area 24 to, in effect, rearwardly extend the forward elevated deck area 16.

Figure 2:
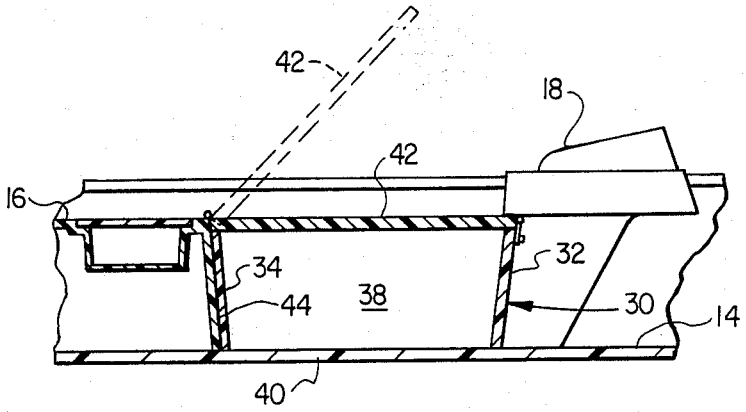
FIG. 2 is a cross-sectional view through the installed casting deck and storage locker unit.

Referring now to FIGS. 1 and 2, the unit 30 has a generally box-like configuration and is provided with a front end wall 32, a rear end wall 34, a pair of opposite side walls 36 and 38, an open bottom 40 and a hinged and lockable upper lid portion 42. As illustrated, the unit 30 is dimensioned to be closely received within and essentially fill the walk-through area 24 so that the unit's rear end wall 34 is closely contiguous with the vertical side wall 44 of the elevated deck 16, its side walls 36 and 38 are closely contiguous with the facing vertical side walls of the lockers 20 and 22, and the upper surface of its hinged lid 42 (with the lid in its closed position) is flush with the upper surfaces of the deck 16 and the locker lids 26 and 28. As can best be seen in FIG. 2, the lid 42 may be pivoted upwardly and forwardly to provide access to the interior of the unit 30 for storing various fishing equipment and other gear.

In addition to providing in a very simple and economical manner additional enclosed storage space on the boat 12, the drop-in unit 30 also forms, in conjunction with the locker lids 26 and 28, a very substantial rearward extension of the forward elevated casting deck 16 along the length of the walk-through area 24. In this manner, the walk-through area 24 which, from a fishing standpoint, was previously not particularly desirable, is converted to an elevated deck area of the boat, which together with the existing deck area 16 now provides a comfortable elevated fishing area for more than one angler. This very conveniently permits two anglers to simultaneously fish in a comfortable manner in an elevated position at the more desirable bow end of the boat. Additionally, if there are more than the conventional two anglers in the boat, three of them can comfortable fish from an elevated platform area—two on the now-extended elevated front deck area and the third on the existing elevated rear deck area.

The combination casting deck/storage locker unit 30, which may be inexpensively formed from a variety of suitably sturdy, lightweight and weatherproof materials such as fiberglass, high strength plastic or the like, may be quickly lifted out of the walk-through area 24, removed from the boat 12, and then stored in a suitable location until it is needed again to conveniently form additional elevated front deck area and provide additional enclosed storage space on the boat 12.

The foregoing detailed description is to be clearly understood as being given by way of illustration and example only, the spirit and scope of the present invention being limited solely by the appended claims.

What is claimed is:

1. For use in a boat having an elevated deck area and a downwardly offset walk-through passage area extending horizontally from said deck area and bounded on opposite sides by elevated structures having upper surfaces defining horizontal extensions of said upper surface of said elevated deck area, apparatus for defining with said elevated structures a horizontal extension of said elevated deck area and for providing an enclosed storage area on said boat, said appartus comprising:

wall means for defining an enclosed, self-supporting hollow storage locker structure adapted to receive items to be stored and configured to be removably inserted into said walk-through passage area in a relatively close fitting relationship therewith, said locker structure being removable as a unit from within said walk-through passage area and having an upper wall section with an upper surface which, with said locker structure operatively inserted into said walk-through passage area, defines a horizontal continuation of the upper surfaces of said elevated deck area and said elevated structures to thereby form a horizontal extension of said elevated deck area over said walk-through passage area.

2. The apparatus of claim 1 wherein:

said boat is a bass boat;

said elevated deck area is positioned at the bow end of the boat;

said elevated structures are storage lockers and extend rearwardly from said elevated deck area;

said locker structure is configured to be closely received in and essentially fill said walk-through passage area; and said upper wall section is movable relative to the balance of said locker structure and defines an access door portion thereof.

3. The apparatus of claim 2 wherein:

said upper wall section is pivotally connected to the balance of said locker structure.

4. A bass boat comprising:

a hull;

an elevated fishing deck positioned at the bow end of said hull;

a duality of elevated storage compartment structures extending rearwardly from said elevated fishing deck along opposite sides of said hull and defining therebetween a downwardly offset walk-through passage area bounded at its inner end by said elevated fishing deck, said storage compartment structures having upper surfaces defining horizontally rearward extensions of the upper surface of said elevated fishing deck; and a portable, enclosed hollow locker storage unit having integral, generally vertically extending supporting side wall portions, said locker storage unit being removably and closely received in, and essentially filling, said walk-through passage area, said locker storage unit having an upper wall section which is movable relative to the balance thereof between open and closed positions to provide access to the interior of said locker storage unit for storage of items therein, said upper wall section, in its closed position, having an upper surface which defines a horizontal continuation of the upper surfaces of said storage compartment structures and said elevated fishing deck over said walk-through passage area to thereby form, with with upper surfaces of said storage compartment structures, a substantial, essentially continuous rearward extension of said elevated fishing deck a central portion of which is supported by said side wall portions and adapted to support the weight of a fisherman standing thereon.

* * * * *